United States Patent [19]

Corcoran

[11] 4,220,245

[45] Sep. 2, 1980

[54] WINE RACK

[76] Inventor: Patrick G. Corcoran, 3014 Rollison, Redwood City, Calif. 94063

[21] Appl. No.: 929,433

[22] Filed: Jul. 31, 1978

[51] Int. Cl.[2] ..... A47B 73/00

[52] U.S. Cl. ..... 211/49 R; 211/74

[58] Field of Search ..... 211/49 R, 49 D, 74, 211/77, 181, 194; 312/234.4, 45

[56] References Cited

U.S. PATENT DOCUMENTS

| | | | |
|---|---|---|---|
| D. 154,913 | 8/1949 | Kay | 211/74 |
| 2,555,102 | 5/1951 | Anderson | 211/74 X |
| 2,730,825 | 1/1956 | Wilds | 211/49 R |
| 3,007,708 | 11/1961 | Ochs | 211/181 X |
| 3,023,908 | 3/1962 | Ramey | 211/74 |
| 3,092,257 | 6/1963 | Rountree | 211/49 R |
| 3,203,554 | 8/1965 | Pendergrast et al. | 312/45 X |
| 3,836,008 | 9/1974 | Mraz | 211/49 R |
| 3,870,156 | 3/1975 | O'Neill | 211/74 |
| 3,879,095 | 4/1975 | Seamans et al. | 312/45 |
| 3,945,501 | 3/1976 | Jay | 211/194 |

FOREIGN PATENT DOCUMENTS

| | | | |
|---|---|---|---|
| 1112652 | 11/1955 | France | 211/74 |
| 1397336 | 3/1965 | France | 211/74 |
| 1577963 | 4/1969 | France | 211/74 |
| 6504671 | 10/1965 | Netherlands | 211/74 |
| 985397 | 10/1965 | United Kingdom | 211/74 |

*Primary Examiner*—Thomas J. Holko

*Attorney, Agent, or Firm*—Julian Caplan

[57] ABSTRACT

A rectangular frame formed of spaced-apart, parallel metal rods with a plurality of vertical compartments open along the front, each compartment adapted to hold horizontally disposed and vertically stacked wine bottles. A metal restraining rod extends horizontally across the open front of the frame slightly above the bottom thereof, for restraining and tilting upward the lowermost bottles in each stack, to thereby tilt the entire stack and prevent any of the bottles from sliding out. Four hollow metal tubes are vertically disposed along the edges of the frame, the lower ends of each tube having reduced cross-sectional portions so they can be inserted into the upper ends of a similar rack, to increase the height of the rack or for stacking purposes.

5 Claims, 5 Drawing Figures

WINE RACK

BACKGROUND OF THE INVENTION

This invention relates to wine racks and, more particularly, to wine racks allowing wine bottles to be stored and displayed in horizontal stacks.

Bottles of wine are preferably stored in horizontal positions, i.e., on their sides, to prevent drying out of the corks and resulting spoilage of the wine. The requirement of horizontal storage, however, usually requires cumbersome wine racks which take up considerable space and are awkward to fill with bottles. Also, conventional wine racks which do allow vertical stacking of bottles often fail to perform any display function, in that the bottles cannot be readily seen by a prospective customer.

Most importantly, wine racks currently available for horizontal holding and displaying of wine bottles, and which allow the bottles to be easily removed or replaced, do not adequately restrain the bottles within the rack. Too often, a customer or a store clerk will bump against the wine rack, causing the bottles above the bottommost bottle to slide out of their vertical compartments and fall to the floor. Presently available wine rack constructions seeking to remedy this problem have been found to be either too expensive or impractical.

SUMMARY OF THE INVENTION

In accordance with this invention there is provided a wine rack having a frame with a plurality of vertical compartments open along the front, each compartment being adapted to hold horizontally disposed and vertically stacked wine bottles with their cork ends facing the open front. The bottles rest on their sides on top of each other. Additionally, the frame has a horizontal lip or metal bar extending across the open front and slightly above the bottom thereof, for restraining the lowermost bottles in each stack. In some locations it is permissible to stack the bottles flat and on top of each other. Where the rack is likely to be bumped, the bottom wine bottle is pulled forward so the enlarged end of the neck will rest on the lip, causing backward tilting of the entire stack and thereby serving to restrain any of the bottles in the stack from sliding out of the rack. Additionally, hollow metal tubes are vertically disposed at the edges of the frame, the tubes having reduced cross-sectional lower portions such that they can be inserted into the hollow upper portions of another rack, for stacking purposes or the like.

It is a primary object of this invention to provide a wine rack capable of storing wine bottles in vertical stacks while preventing any of the bottles in a stack from sliding out.

It is another object of this invention to provide a wine rack having stackable legs such that one rack can be combined with another without the use of tools.

It is a further object of this invention to provide secure vertical stacking of wine bottles while at the same time allowing the bottles to be easily removed by a customer or replaced by a store clerk.

It is yet another object of this invention to provide a wine rack which allows vertical stacking of wine bottles with a wire basket above each stack for displaying a representative bottle from each stack.

It is a further object of this invention to provide a versatile, low cost wine rack for securely storing and displaying both standard and longer wine bottles.

The present invention provides a modular wine racking system to store and to display bottles in vertical columns. Each module may be stacked on top of another unit of similar width and depth but, optionally of different height.

The modules may be placed back-to-back to provide a free-standing display or "gondola".

Further, by removing some of the shelves of a conventional store shelf structure, the module may be inserted between the uprights of the shelf. Indeed, by fitting the modules into two facing parallel shelf units and into a transverse unit at the end of the two facing units, the invention gives the appearance of a walk-in wine cellar.

Thus the present invention provides versatility in the display of wine bottles and safety against breakage because the bottles may be stood flat when the units are not likely to be jarred or tilted backward where store traffic is likely to jar the racks.

These and other objects of the invention will become apparent to those skilled in the art from a reading of the description of the preferred embodiment, as well as from examining the following described drawings.

DESCRIPTION OF THE PREFERRED EMBODIMENT

Figure 1:
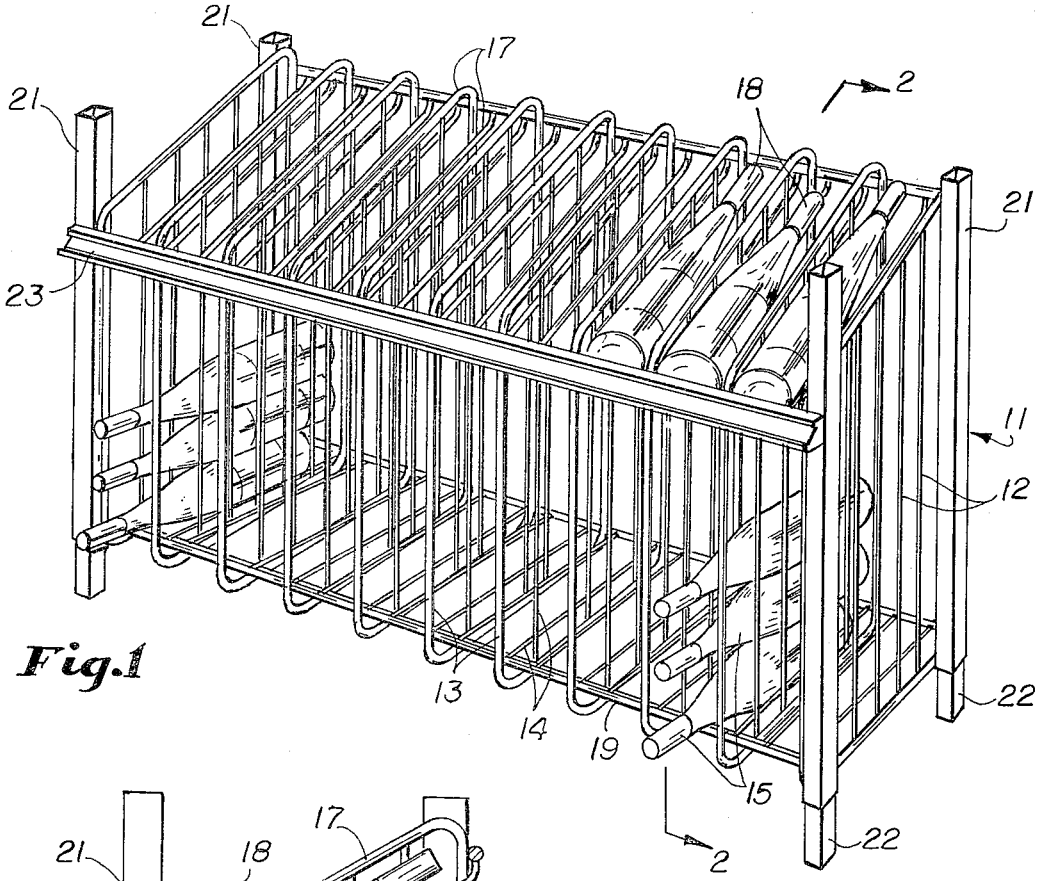
FIG. 1 is a perspective front view of the wine rack of this invention.

Referring to FIG. 1, wine rack 11 is rectangular in shape and formed of spaced-apart, parallel metal rods 12. Rods 13 and inner support rods 14 define vertical compartments adapted for the vertical stacking of wine bottles 15, each compartment being open along the front of the wine rack. Rods 17, disposed at an angle across the top of the wine racks define display baskets for wine bottles 18, such that a representative bottle from each stack can be displayed in the basket above it.

A metal bar 19 extends horizontally across the front of the wine rack, slightly above the bottom thereof, for restraining the wine bottles in any of the vertical stacks, in a manner as will be described below. Square metal tubes 21 define the vertical edges of the frame and have reduced cross-sectional portions 22 at their lower ends. The reduced cross-sectional portions 22 can be inserted into the hollow upper portions of the tubes of a corresponding wine rack, for stacking purposes or the like. Molding 23 is secured horizontally across the upper portion of the wine rack, for the attachment of price markers.

Preferably, the wine rack 11 has a width of from about two feet to four feet. A three foot wide unit, having a height of about 32 inches and a depth of about 12 inches, will provide a 72 bottle holding capacity. Yet such unit will weigh no more than about 45 pounds. Snap-in foot runners (not shown) can be inserted into the hollow lower portions of metal bars 21 to equalize floor weight.

Figure 5:
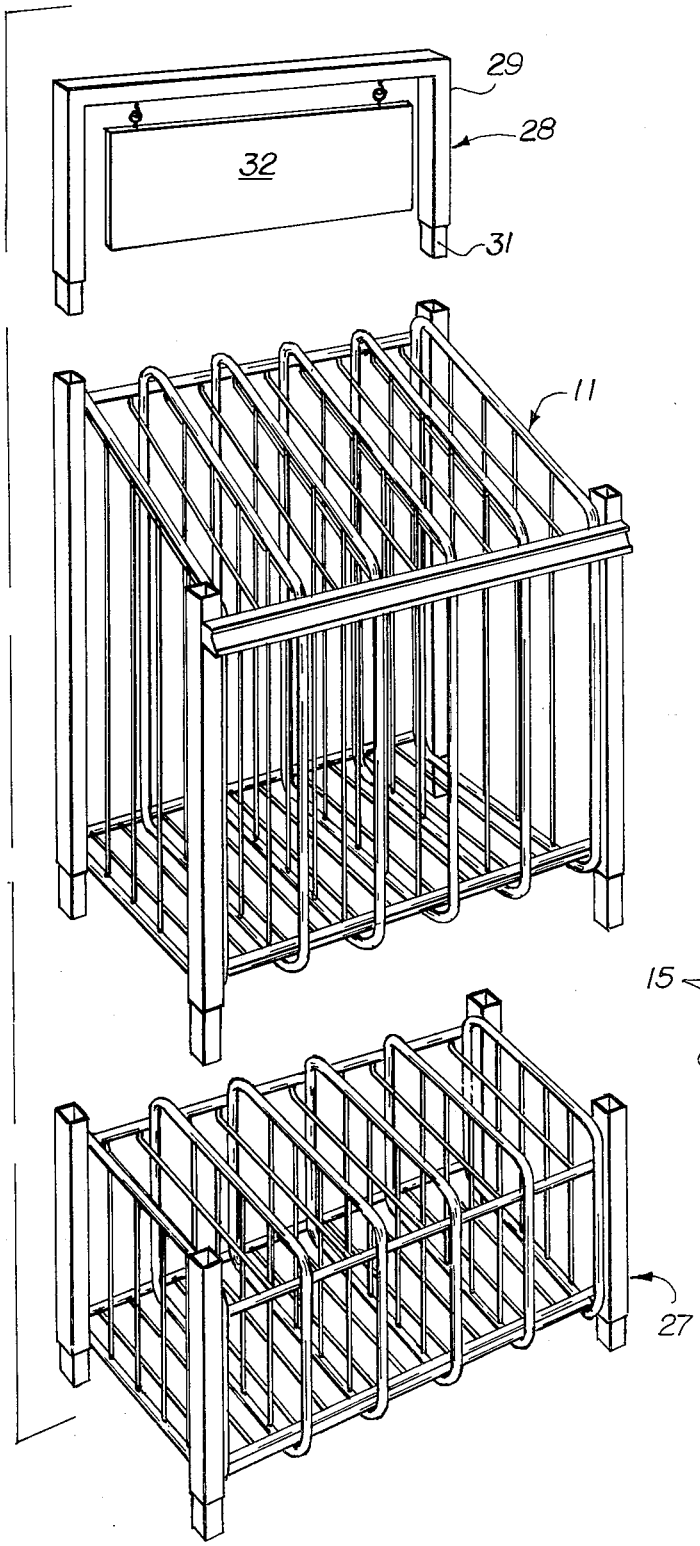
FIG. 5 is an exploded view showing the wine rack together with a drop-in sign holder and a riser unit.

The basic wine rack unit shown in FIG. 1 is extremely versatile. It can be combined with a sign holder and sign, and riser unit, as shown in FIG. 5, or it can be combined with a corresponding unit either back-to-back or one on top of the other.

It is seen from FIG. 1 that wine rack 11 provides a convenient means for both the holding and displaying of wine bottles. Wine bottles 18 are highly visible within the display baskets, and vertically stacked bottles 15 are also readily accessible. The uppermost bottle of each of the vertical stacks can be removed therefrom by grasping the neck of the bottle and pulling it through the open end of each compartment. Restraining bar 19 will adequately restrain the lowermost bottle in each of the stacks if the wine rack is in a location where it is not likely to be bumped by a customer or store personnel. Where the wine rack is in a location where bumping can occur, the lowermost bottle in each stack is pulled out slightly, on top of the restraining bar as shown in FIG. 3, to tilt the entire stack and thereby prevent any of the bottles from sliding out should the stack be bumped.

Figure 2:
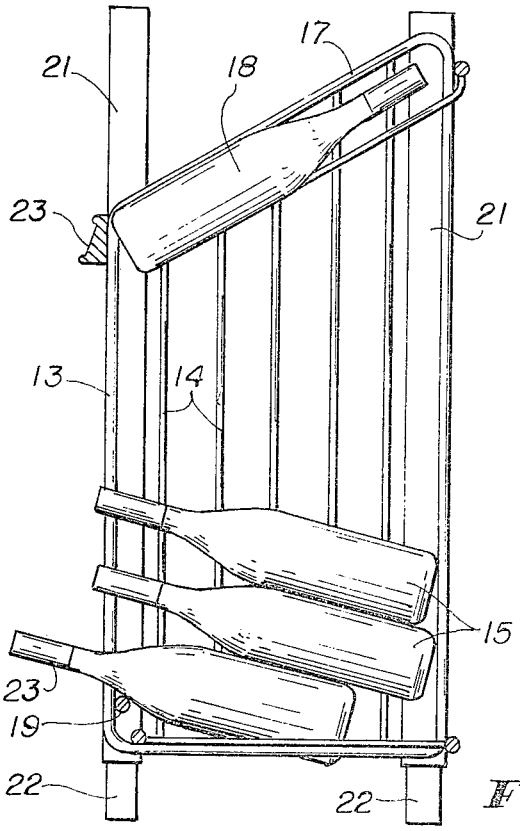
FIG. 2 is a fragmentary cross-sectional view taken along the line 2—2 of FIG. 1 showing the lowermost bottle tilted and all other bottles tilted upwardly.
Figure 3:
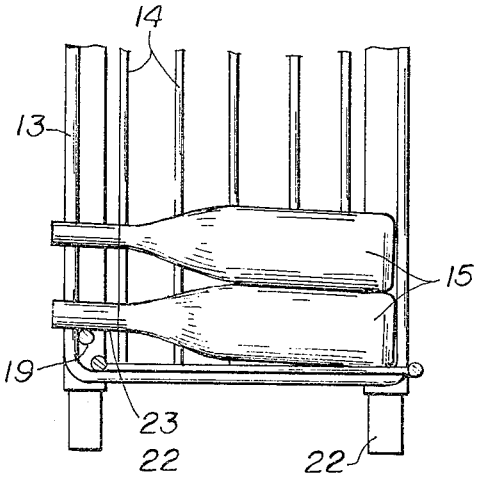
FIG. 3 is a fragmentary sectional view similar to FIG. 2 except that the lowermost bottle is substantially flat.

As shown by FIGS. 2, 3, longer wine bottles, typically of a length of about 13¼ inches, can be horizontally stacked such that their necks 23 rest upon the metal restraining bar 19. In FIG. 3, the bottles are shown in a flat or horizontal position. In FIG. 2, the lowermost bottle 15 is shown after it has been pulled slightly from the wine rack. The neck and shoulder of the lowermost bottle rides upon the restraining bar 19, causing the bottle to tilt upwardly as shown, thereby causing the entire stack of bottles 15 to tilt backwardly. As a result, each of the bottles of the stack will be urged back against the end wall 25 of the wine rack rather than forward to where it might slide out of the wine rack.

Figure 4:
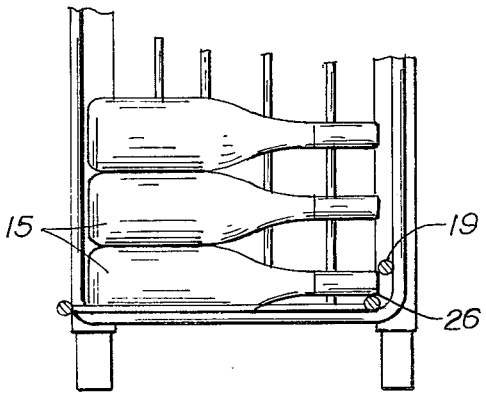
FIG. 4 is the same view as FIG. 2, but showing standard size wine bottles instead of the longer wine bottles.

As shown in FIG. 4, standard wine bottles, having a length of about 12 inches, are shown within a vertical compartment of the wine rack 11. The cork end 26 of the lowermost bottle 15 is shown abutting restraining bar 19, to securely restrain the lowermost bottle in the stack from sliding out of the rack. Where bumping of the rack might occur, the lowermost bottle is grasped by the neck and pulled onto the restraining bar 19 to the position as shown for the longer bottle in FIG. 2, thereby assuring that upon movement of the wine rack the backward tilting of the upper bottles will be accomplished, so as to steady the entire horizontal stack.

As is seen from FIGS. 2–4, the depth of the wine rack is determined by the lengths of the wine bottles to be stored. Wine rack 11, for the storage of standard and longer wine bottles, thus will have a depth of about 12 inches. Of course, greater or lesser depths can be used for bottles of other lengths.

As shown in FIG. 5, wine rack 11 can serve as the basic unit in an extended rack including riser unit 27, formed the same as wine rack 11, and sign holder 28. The riser unit 27 is about 9 inches high, and can be used in a four foot wide wine rack, for example, to increase the height from 35 inches to 44 inches, and to thereby increase bottle capacity from 96 bottles to 120 bottles. The drop-in sign holder 28 has hollow vertical bars 29 with reduced cross-sectional portions 31 which can be inserted into the hollow upper portions of wine rack 11. Sign 32 can then be suspended between vertical bars 29 of the drop-in holder 28. The drop-in sign holder 28, wine rack 11, and riser unit 27 can be combined as described without the use of tools, and can be as easily disassembled. However used, wine rack 11 will provide a store owner with an inexpensive and yet secure means for both the storage and displaying of wine bottles.

I claim:

1. A wine rack comprising:

a frame having a plurality of vertical compartments entirely open along the front, each compartment adapted to hold substantially horizontally disposed and vertically stacked wine bottles with their cork ends facing the front, the frame additionally having a horizontal restraining bar extending across the open front of the frame, slightly above the bottom thereof, for restraining and tilting the lowermost bottles in each stack so as to tilt each stack and thereby prevent any of the bottles in a stack from sliding out of the rack and wherein each compartment has a depth sufficient to fully enclose standard wine bottles, such that when the bottles are flat their cork ends will abut the horizontal restraining bar, the depth also being such that the necks of longer wine bottles will protrude outside of the wine rack, whereby the bottommost of both the standard and longer bottles optionally can be pulled out slightly and tilted within each stack, to thereby tilt all of the bottles in the stack and also to restrain them from sliding out of the rack or optionally the bottommost bottle may be fully inserted within each stack whereby all the bottles in the stack will be horizontally disposed.

2. The wine rack of claim 1 wherein the frame is rectangular and is formed of spaced-apart, parallel metal rods with a hollow metal tube vertically disposed along each vertical edge, the lowermost portions of the tubes having reduced cross-sectional areas such that they can be inserted into the upper portions of another such rack, to combine the two into a single wine rack.

3. The wine rack of claim 2 additionally comprising a drop-in sign holder having a pair of vertically disposed hollow metal tubes connected at their upper ends by a horizontal bar, with the lower portions of the vertical tubes having reduced cross-sectional areas such that the holder can be inserted into the hollow upper portions of the wine rack and a sign can be suspended from the horizontal bar.

4. The wine rack of claim 2 additionally comprising a riser unit formed substantially the same as the wine rack but having substantially less height, such that the riser unit can be placed under the wine rack with the legs thereof inserted into the hollow opening of riser unit's metal tubes, to give added bottle storing capacity to the wine rack.

5. The wine rack of claim 2 additionally having a horizontal molding member disposed across the upper portion of the wine rack and adapted for holding price markers.

* * * * *